US008285156B2

(12) United States Patent
Thayer et al.

(10) Patent No.: US 8,285,156 B2
(45) Date of Patent: Oct. 9, 2012

(54) APPARATUS AND METHOD FOR DETERMINING TONER AGE IN A PRINTING APPARATUS

(75) Inventors: Bruce Earl Thayer, Spencerport, NY (US); Aaron Michael Burry, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 217 days.

(21) Appl. No.: 12/822,681

(22) Filed: Jun. 24, 2010

(65) Prior Publication Data

US 2011/0318023 A1 Dec. 29, 2011

(51) Int. Cl.
*G03G 15/08* (2006.01)
*G03G 15/00* (2006.01)

(52) U.S. Cl. ..... 399/29; 399/49; 399/257

(58) Field of Classification Search ..... 399/27, 399/29, 49, 257, 350
See application file for complete search history.

(56) References Cited

U.S. PATENT DOCUMENTS

| | | | | |
|---|---|---|---|---|
| 6,507,724 | B2 * | 1/2003 | Tamura et al. | 399/350 |
| 2009/0110416 | A1 | 4/2009 | Thayer et al. | |
| 2009/0304406 | A1 | 12/2009 | Thayer et al. | |
| 2010/0053293 | A1 | 3/2010 | Thayer et al. | |

* cited by examiner

*Primary Examiner* — David Gray
*Assistant Examiner* — Erika J Villaluna
(74) *Attorney, Agent, or Firm* — Ronald E. Prass, Jr.; Prass LLP

(57) ABSTRACT

An apparatus and method that determines toner age in a printing apparatus. The method can include placing an imaging surface cleaner in contact with an imaging surface. The method can include placing a toner patch on the imaging surface. The method can include rotating the imaging surface in a process direction. The method can include measuring a frictional interaction between the imaging surface cleaner and the imaging surface as the toner patch passes the imaging surface cleaner. The method can include determining whether toner should be purged based on the measured frictional interaction. The method can include purging the toner if the toner should be purged.

18 Claims, 4 Drawing Sheets

APPARATUS AND METHOD FOR DETERMINING TONER AGE IN A PRINTING APPARATUS

BACKGROUND

Presently, image output devices, such as printers, multifunction media devices, xerographic machines, ink jet printers, and other devices produce images on media sheets, such as paper, substrates, transparencies, plastic, labels, or other media sheets. To produce an image, marking material, such as toner, ink jet ink, or other marking material, is applied from a developer to a photoreceptor. The marking material is transferred to a media sheet to create an image on the media sheet.

Toner in developer development housings is subjected to forces which eventually age the toner by impacting external additives into the toner surface. The toner additives are much less effective when they have been impacted into the surface. As a result, the behavior of the material can be affected in both development and transfer.

One solution to combat this problem is the implementation of a toner purge cycle that develops out bands of toner in interdocument zones. Purging of the impacted toner results in dispensing of fresh toner into the development housing to maintain the desired toner concentration and percentage of toner with effective external additives. Toner additive impaction is determined by residence time in the development housing. Machine controls approximate toner residence time by estimating toner usage for each color and making assumptions about the developer composition of aged and fresh toner particles. Unfortunately, the purging of toner is wasteful because it is based on general trends and not on the actual toner condition.

Another solution to the toner aging problem is reducing the abuse of the material within the developer housing. This is commonly referred to as a low abuse housing or gentle development. Unfortunately, although these solutions tend to improve the material abuse problem, they do not eliminate it entirely, and purge cycles are still required.

Thus, there is a need for an apparatus and method that determines toner age in a printing apparatus that reduces the required amount of purge toner to the smallest effective amount.

SUMMARY

An apparatus and method that determines toner age in a printing apparatus is disclosed. The apparatus and method can reduce the required amount of purge toner to the smallest effective amount. The method can include placing an imaging surface cleaner in contact with an imaging surface. The method can include placing a toner patch on the imaging surface. The method can include rotating the imaging surface in a process direction. The method can include measuring a frictional interaction between the imaging surface cleaner and the imaging surface as the toner patch passes the imaging surface cleaner. The method can include determining whether toner should be purged based on the measured frictional interaction. The method can include purging the toner if the toner should be purged.

BRIEF DESCRIPTION OF THE DRAWINGS

In order to describe the manner in which advantages and features of the disclosure can be obtained, a more particular description of the disclosure briefly described above will be rendered by reference to specific embodiments thereof, which are illustrated in the appended drawings. Understanding that these drawings depict only typical embodiments of the disclosure and do not limit its scope, the disclosure will be described and explained with additional specificity and detail through the use of the drawings in which.

DETAILED DESCRIPTION

The embodiments include a method that determines toner age in a printing apparatus that can have an imaging surface and an imaging surface cleaner. The method can include placing the imaging surface cleaner in contact with the imaging surface. The method can include placing a toner patch on the imaging surface. The method can include rotating the imaging surface in a process direction. The method can include measuring a frictional interaction between the imaging surface cleaner and the imaging surface as the toner patch passes the imaging surface cleaner. The method can include determining whether toner should be purged based on the measured frictional interaction. The method can include purging the toner if the toner should be purged.

The embodiments further include a printing apparatus that determines toner age. The apparatus can include an imaging surface, where the imaging surface can be configured to rotate in a process direction. The apparatus can include an imaging surface cleaner in contact with the imaging surface. The apparatus can include a developer configured to develop a toner patch for placement on the imaging surface. The apparatus can include a sensor configured to sense a frictional interaction between the imaging surface cleaner and the imaging surface as the toner patch passes the imaging surface cleaner. The apparatus can include a controller configured to determine whether toner should be purged based on the sensed frictional interaction and configured to control the printing apparatus to purge the toner if the toner should be purged.

The embodiments further include a method that determines toner age in a printing apparatus that can have at least one developer, a photoreceptor cleaning blade, a photoreceptor having a photoreceptor surface, and a sensor. The method can include placing the photoreceptor cleaning blade in contact with the photoreceptor surface. The method can include developing a toner patch on the photoreceptor surface using the at least one developer. The method can include rotating the photoreceptor in a process direction. The method can include measuring a frictional interaction between the photoreceptor cleaning blade and the photoreceptor surface using the sensor as the toner patch passes the photoreceptor cleaning blade. The method can include determining whether toner should be purged based on the measured frictional interaction. The method can include purging the toner if the toner should be purged.

Figure 1:
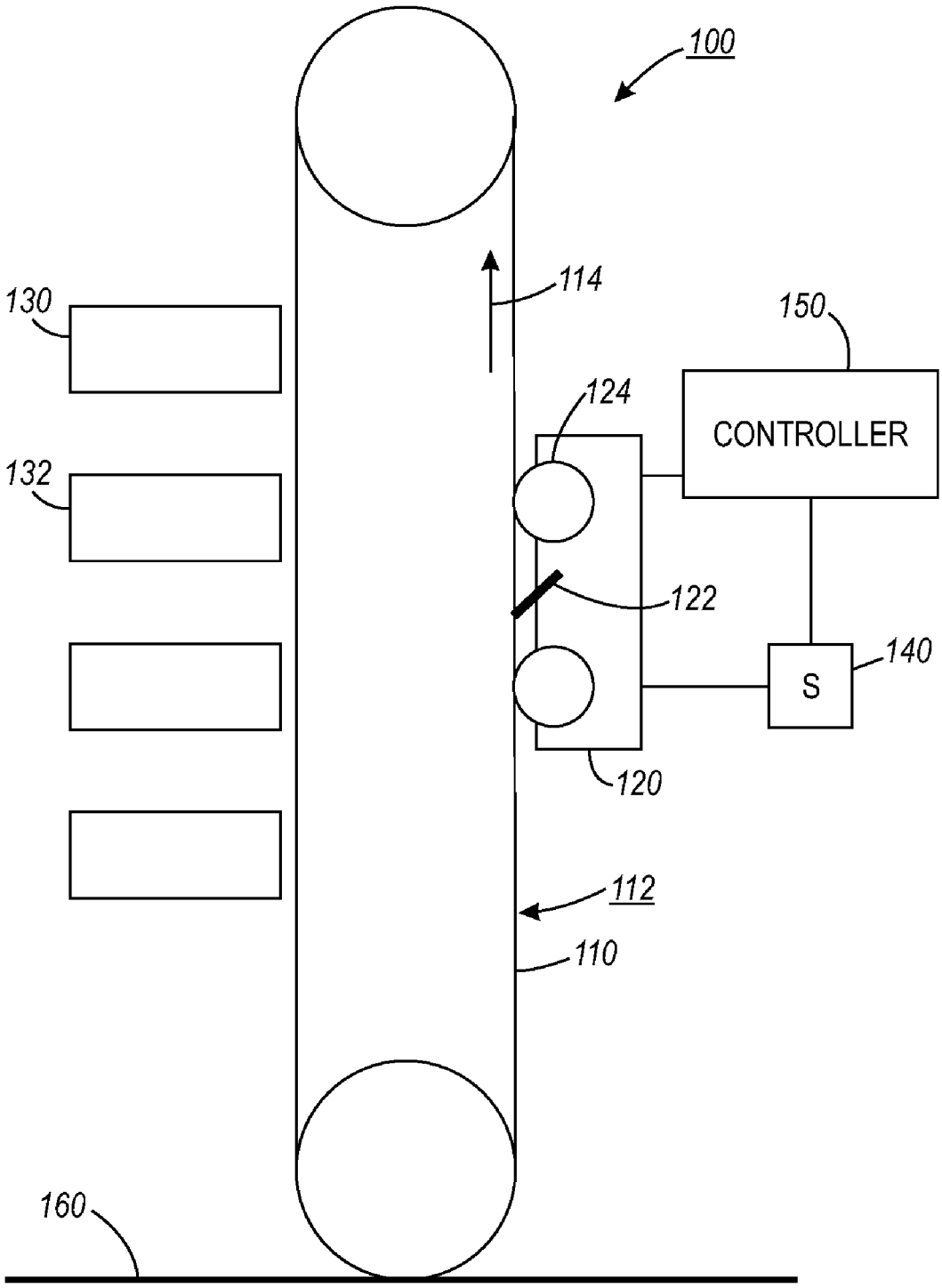
FIG. 1 is an exemplary illustration of an apparatus.

FIG. 1 is an exemplary illustration of an apparatus 100. The apparatus 100 may be a printer, a multifunction media device, a xerographic machine, or any other device that produces images on media. The apparatus 100 can include an image transport 110 having an imaging surface 112. The image transport 110 can be a photoreceptor 110 having a photoreceptor surface 112. The image transport 110 can also be an intermediate belt, or any other image transport that can have an imaging surface on which toner is placed for subsequent transfer to another surface, such as a print sheet. For example, such an imaging surface can be that of an intermediate belt on which toner from multiple individual-color photoreceptors are accumulated for transfer onto a print sheet. An imaging surface can also relate to an individual photoreceptor, such as for a single primary color, that transfers toner onto an intermediate belt or directly onto a print sheet in a monochrome or color printing apparatus. For ease of illustration, embodiments will be described with respect to a photoreceptor 110. However, such embodiments can be used with any imaging surface on which toner is placed for subsequent transfer to another surface. The photoreceptor 110 can be a photoreceptor drum, a photoreceptor belt, or any other device that can transport images. The photoreceptor 110 can be configured to rotate in a process direction 114.

The apparatus 100 can include a photoreceptor cleaner 120 in contact with the photoreceptor surface 112. The photoreceptor cleaner 120 can include or can be a cleaning blade, a foam roll, an electrostatic roll, a brush, or any other device that cleans a photoreceptor. For example, the photoreceptor cleaner 120 can be a cleaning blade 122 or an electrostatic roll 124.

The apparatus 100 can include a developer 130 configured to develop a toner patch on the photoreceptor surface 112. The toner patch can be an image or can be a dedicated toner patch used to determine toner age in the apparatus 100. The developer 130 can be one of a plurality of developers 130 and 132. The developer 130 can develop the toner patch on the photoreceptor surface 112 in an interdocument zone. The toner patch can also be developed on a single photoreceptor panel that is not transferred, can be developed in between print jobs, can be developed during a process control cycle, or can be otherwise developed on the photoreceptor 110.

The apparatus 100 can include a sensor 140 configured to sense a frictional interaction between the photoreceptor cleaner 120 and the photoreceptor surface 112 as the toner patch passes the photoreceptor cleaner 120. The sensor 140 can be a strain gauge, an accelerometer, an optical sensor, an acoustic sensor, a capacitive sensor, or any other sensor that can sense frictional interaction between the photoreceptor cleaner 120 and the photoreceptor surface 112. For example, blade strain on the cleaning blade 112 can be sensed in a number of ways. The sensor 140 can sense a frictional interaction between the photoreceptor cleaner 120 and the photoreceptor surface 112 by sensing strain on the cleaning blade 122 as the toner patch passes the cleaning blade 122. A strain gage can be used to sense the blade strain because it can be relatively inexpensive, can be reliable, and can compensate for temperature. Also, a frictional load can be measured on a cleaning blade 122 or other cleaner with respect to the photoreceptor surface 112. Additionally, a capacitive sensor can be used by placing a conductive patch on the photoreceptor cleaner 120 and by measuring the capacitance between the conductive patch on the photoreceptor cleaner 120 and a photoreceptor 110 ground plane. Frictional interaction may also be measured in other ways, such as by being based on about motor feedback noise from a rotating cleaning brush, by detection of transient charges within the blade, or by any other way of measuring frictional interaction. A conductive patch can be printed with conductive ink on the cleaning blade 122 as a low cost sensor. The sensor 140 can be configured to output a frictional interaction signal indicative of the sensed frictional interaction.

The apparatus 100 can include a controller 150 configured to determine whether toner should be purged based on the sensed frictional interaction and configured to control the apparatus 100 to purge the toner if the toner should be purged. Purging can include refreshing the toner in the developer 130, such as by flushing out old toner and adding new toner. For example, toner can be developed onto the photoreceptor 110, transfer from the photoreceptor 110 can be minimized, and the toner can be cleaned from the photoreceptor 110 to get rid of old toner. The toner also can be purged by transferring the toner onto media 160, such as paper, transparencies, labels, or other media, can be purged by leaking toner out through a developer housing trickle port, or can be disposed of in any other way. Adding new toner can include adding toner carrier.

The controller 150 can determine whether the toner should be purged based on the frictional interaction signal. The controller 150 can compare the frictional interaction signal to a threshold and can determine the toner should be purged if the frictional interaction signal substantially exceeds the threshold. For example, the frictional interaction signal can substantially exceed the threshold by being at least equal to the threshold or by being greater than the threshold. The threshold can be a first threshold and the controller 150 can compare the frictional interaction signal to a second threshold and can cease purging the toner if the frictional interaction signal substantially falls below the second threshold. For example, the frictional interaction signal can substantially fall below the second threshold by falling below than the second threshold or by being equal to or below the second threshold. The controller 150 can also purge the toner by controlling the apparatus 100 to dispense toner into the developer 130 and develop toner onto the photoreceptor surface 112 from the developer 130. The controller 150 can enter a printing apparatus diagnostic mode and can determine whether the toner should be purged based on the measured frictional interaction during the diagnostic mode. The controller 150 can determine whether the toner should be purged based on sensed strain on the cleaning blade 122.

If there are a plurality of developers 130 and 132, the sensor 140 and controller 150 actions can be performed separately for each of the plurality of developers 130 and 132. The process can also be performed concurrently for all of the plurality of developers 130 and 132. Also, separate color developers can be used and blade strain can be evaluated for each color of toner.

According to some embodiments, a cleaning blade strain sensor can be used to sense the frictional response of the blade to an incoming toner patch separately from each of a plurality of development housings. The known amount of toner on the patch can provide a reference expected level of lubrication for the cleaning blade. As additives are impacted into the surfaces of toner particles, their effectiveness as a blade lubricants change. By comparing the current frictional response of the cleaning blade to the reference frictional response, the additive impaction state of the toner can be inferred. This additive state sensing method can be used to determine when a toner purge is required and used to determine when the additive state of the toner in the development housing has returned to the desired state. This information can also be used in a diagnostic mode to help deduce the source of an output image quality artifact.

For example, in developer housings, additives are blended onto the toner particles so that they are on the surface of the toner particles and active for control of toner tribo, flow, and adhesion. Energy imparted to the toner by the development housing tends to change the lubrication quality of the toner. This is done primarily by altering the condition of the external additives on the toner particles. The agitation forces in a developer housing with long toner residence times can impact the surface additives deeper into the toner particles so that they are no longer exposed to other surfaces for triboelectric interactions or to act as spacer particles between the toner and other surfaces. Agitation forces can also dislodge additives from the surface of particles. In either case, with longer residence time in the developer housing, toner particles begin to look more like parent particles before the additives had been blended onto the surface. The toner thus loses the interaction properties that the additives were intended to enable. This can impact the performance of both the development and transfer subsystems in a printing apparatus.

This can be called a toner aging problem. Separate color toner development housings are continuously run when a machine is printing independent of the need for a particular color toner in the images being printed. Many cases arise where a particular color toner is used very little or not at all in successive jobs of very many prints. The toner in these development housings experiences high impaction forces over prolonged periods of time and toner additive impaction becomes progressively worse.

A toner purge process can be used to reduce the toner aging problem in a printing apparatus. Toner that has been aged by toner additive impaction in development housings can be developed out in interdocument zone bands, cleaned by a cleaner, and sent to a waste bottle. To replace the developed toner, fresh toner is dispensed and the average age of the toner in the development housing is lowered. The frequency of the toner purge event can be based on estimated residence time of the toner in the development housing. For example, the amount of toner material purged can be based on the estimated distribution of aged and fresh toner. While the purge process can improve the toner aging problem it can also result in the waste of a large quantity of toner to maintain good toner properties if it is not based on the actual change in toner properties.

According to some embodiments, toner patches can be developed on a photoreceptor, possibly in interdocument zones, while allowing the patches to pass through transfer, and the strain response of a cleaning blade can be sensed as the patch passes under the cleaning blade. Testing with strain gages on cleaning blades has shown strain signatures corresponding to the toner lubrication level on the photoreceptor. By observing the strain response of the blade to the lubrication level provided by a separate toner patch from each of the development housings, it is possible to evaluate the lubrication condition of toner.

In addition to the benefits from reducing the required toner for purge, embodiments can also be used during machine diagnostics. A common use-case for a diagnostic mode can be that a known problem exists with output prints. The objective can be to locate the source of the problem, such that it can be corrected. Abuse of the toner material can be a problem that can contribute to both development and transfer related print quality issues. By measuring the additive state of the toner, it is possible to provide information to a diagnostic method that can be used to determine if toner abuse is a significant contributing factor to the problem.

Typical toner purging can waste toner to maintain acceptable toner properties in the developed toner. By basing toner purging on actual measured toner properties rather than estimated toner conditions, a significant portion of the wasted toner can be saved and run cost can be reduced. This sensing method could also be applied to a number of print architectures to provide key diagnostic information.

Embodiments can use blade strain measurements to infer the additive state of developed toner. Embodiments can also control developer housing toner purges and can be used for diagnostic purposes. Toner purges based on measurements of actual toner properties can more accurately identify when a purge is needed and can more accurately identify how much toner needs to be purged than previous methods. This optimization of the purge process can result in less toner being wasted than in a general purge process. Reduction in the amount of toner wasted while purging toner can lower run cost. Benefits to run cost can also be achieved through improved diagnostic procedures leveraging the measurements of toner state.

Figure 2:
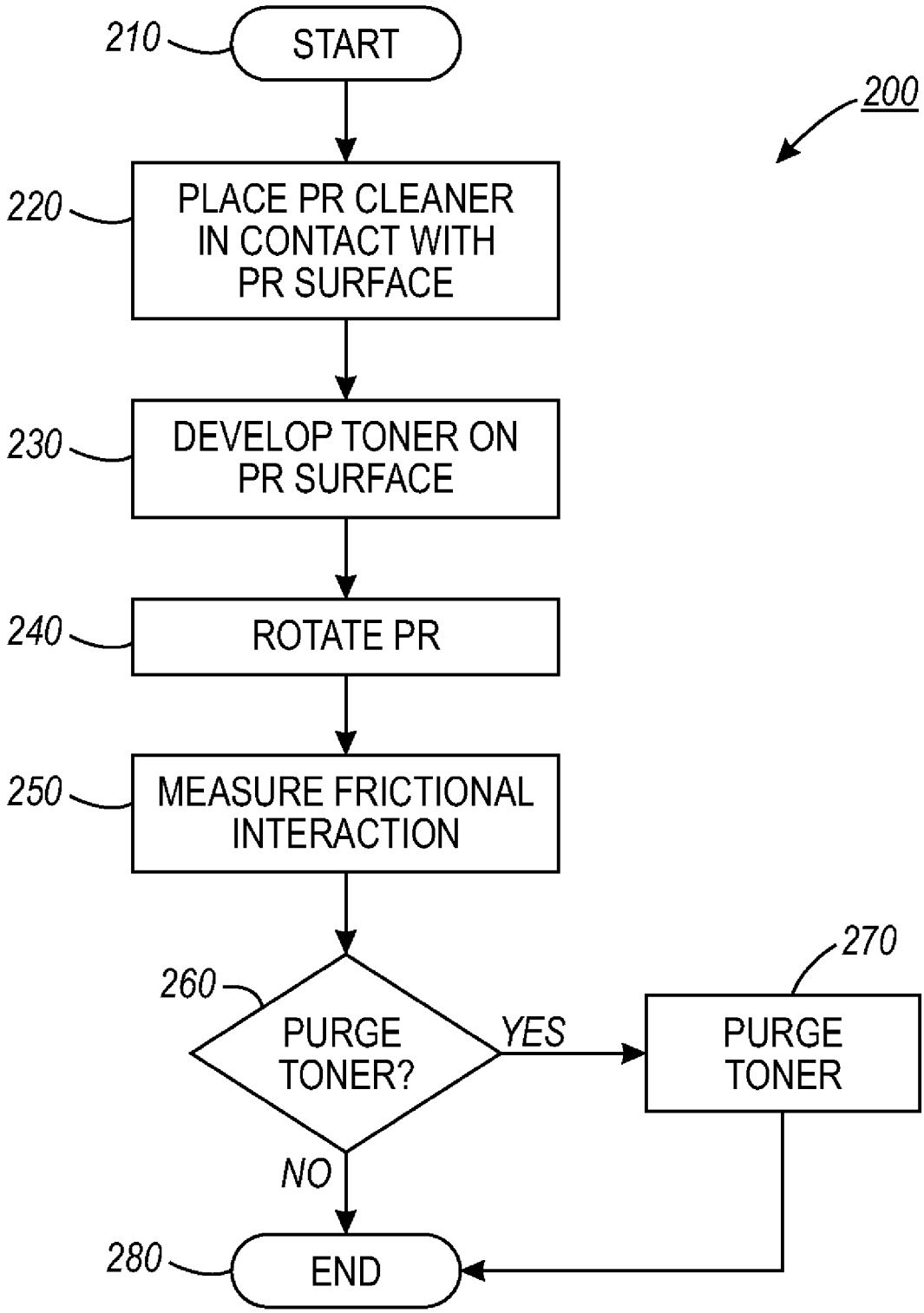
FIG. 2 illustrates an exemplary flowchart of a method of determining toner age in a printing apparatus.

FIG. 2 illustrates an exemplary flowchart 200 of a method of determining toner age in a printing apparatus that can have a photoreceptor cleaner and a photoreceptor having a photoreceptor surface. The method can start at 210. At 220, the photoreceptor cleaner can be placed in contact with the photoreceptor surface. At 230, a toner patch can be developed on the photoreceptor surface. At 240, the photoreceptor can rotate in a process direction. At 250, a frictional interaction between the photoreceptor cleaner and the photoreceptor surface can be measured as the toner patch passes the photoreceptor cleaner. At 260, whether the toner should be purged based on the measured frictional interaction can be determined. At 270, the toner can be purged if the toner should be purged. At 280, the method can end.

According to some embodiments, all of the blocks of the flowchart 200 are not necessary. Additionally, the flowchart 200 or blocks of the flowchart 200 may be performed numerous times, such as iteratively. For example, the flowchart 200 may loop back from later blocks to earlier blocks. Furthermore, many of the blocks can be performed concurrently or in parallel processes.

Figure 3:
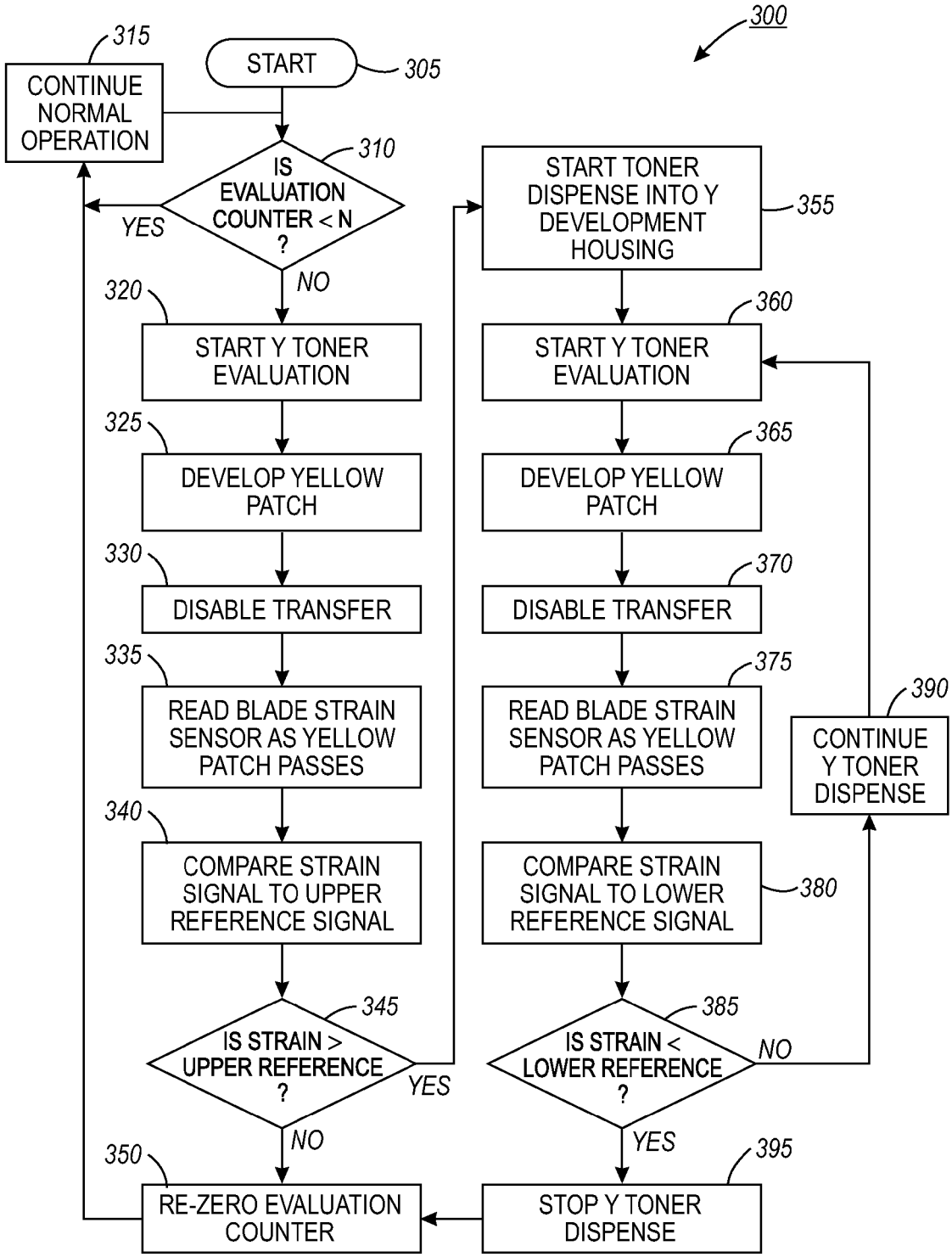
FIG. 3 illustrates an exemplary flowchart of a method of determining toner age in a printing apparatus.

FIG. 3 illustrates an exemplary flowchart 300 of a method of determining toner age in a printing apparatus. The flowchart 300 illustrates an example method for using blade strain to control toner age for yellow toner evaluation. However, operations of the flowchart 300 can be performed for any other color or type of toner. For example, a printing apparatus can include at least one developer or a plurality of developers and the method can performed separately or concurrently for each of the plurality of developers. Also, the method or portions of the method can be performed a printing apparatus diagnostic mode or during normal printing apparatus operation. Furthermore, portions of the flowchart 300 can be combined with the flowchart 200.

The method can start at 305. At 310, an evaluation counter can be used to determine whether toner evaluation should be started. The evaluation counter can be based on a time period, can be based on a number of operations, such as print operations, or can be any other useful evaluation counter. If the evaluation counter is below a threshold, N, at 315 the printing apparatus can continue normal operation. If the evaluation counter is above the threshold N, at 320, toner evaluation can be started.

At 325, a yellow patch of toner can be developed, such as on a photoreceptor. For example, a toner patch can be developed on the photoreceptor surface from at least one developer. A toner patch can be developed on the photoreceptor surface in an interdocument zone, in a document panel, or anywhere else on the photoreceptor during or between print operations. At 330, transfer can be disabled, such as from the photoreceptor to an intermediate transfer belt, to an intermediate transfer roll, or to media.

At 335, a cleaning blade strain sensor can be read as the patch passes a cleaning blade. This is an example of measuring frictional interaction between a photoreceptor cleaner and a photoreceptor surface as a toner patch passes the photoreceptor cleaner. For example, a frictional interaction between the photoreceptor cleaner and the photoreceptor surface can be measured using a sensor as the toner patch passes the photoreceptor cleaner and the sensor can output a frictional interaction signal indicative of the measured frictional interaction. At 340, the blade strain signal can be compared to an upper reference signal. For example, whether the toner should be purged can be determined based on a frictional interaction signal.

At 345, if the blade strain signal is below the upper reference, the evaluation counter can be re-zeroed at 350, and normal operation can be continued at 315. If the blade strain signal is above the upper reference, at 355, toner can begin to be dispensed into the yellow development housing. For example, at 345, a frictional interaction signal can be compared to a threshold and if the frictional interaction signal substantially exceeds the threshold the method can determine that toner should be purged.

At 360, yellow toner evaluation can start. At 365, a yellow toner patch can be developed onto the photoreceptor as part of a purging process. For example, purging can include dispensing toner into the at least one developer and developing toner onto the photoreceptor surface from the at least one developer. A toner patch can be developed on the photoreceptor surface in an interdocument zone, in a document panel, or anywhere else on the photoreceptor useful during or between print operations. At 370, transfer can be disabled. At 375, a cleaning blade strain sensor can be read as the patch passes a cleaning blade. For example, a frictional interaction between the photoreceptor cleaner and the photoreceptor surface can be measured using a sensor as the toner patch passes the photoreceptor cleaner and the sensor can output a frictional interaction signal indicative of the measured frictional interaction.

At 380, the blade strain signal can be compared to a lower reference signal. For example, whether the toner should continue to be purged can be determined based on comparing a frictional interaction signal to a threshold. At 385, if the blade strain signal is below the lower reference, yellow toner dispense can be stopped at 395, the evaluation counter can be re-zeroed at 350, and normal operation can be continued at 315. If the blade strain signal is above the lower reference, at 390, yellow toner can continue to be dispensed into the yellow development housing and toner evaluation can be continued at 360. For example, at 385, a frictional interaction signal can be compared to a threshold and purging toner can cease if the frictional interaction signal substantially falls below the threshold.

According to some embodiments, all of the blocks of the flowchart 300 are not necessary. Additionally, the flowchart 300 or blocks of the flowchart 300 may be performed numerous times, such as iteratively. For example, the flowchart 300 may loop back from later blocks to earlier blocks. Furthermore, many of the blocks can be performed concurrently or in parallel processes.

The flowchart 300 can illustrate a process to control blade strain, and thus toner age, within upper and lower reference limits. The example uses yellow toner, but similar steps can apply for all colors in a printing apparatus. The toner patches can be conveniently developed in interdocument zones, but there are other options. For example, toner patches of all of the colors can be printed on a single photoreceptor panel that is not transferred. The blade strain can be evaluated for each color toner and one print interruption in a print job can occur. To avoid the job interruption, the test patches could be developed between jobs.

Figure 4:
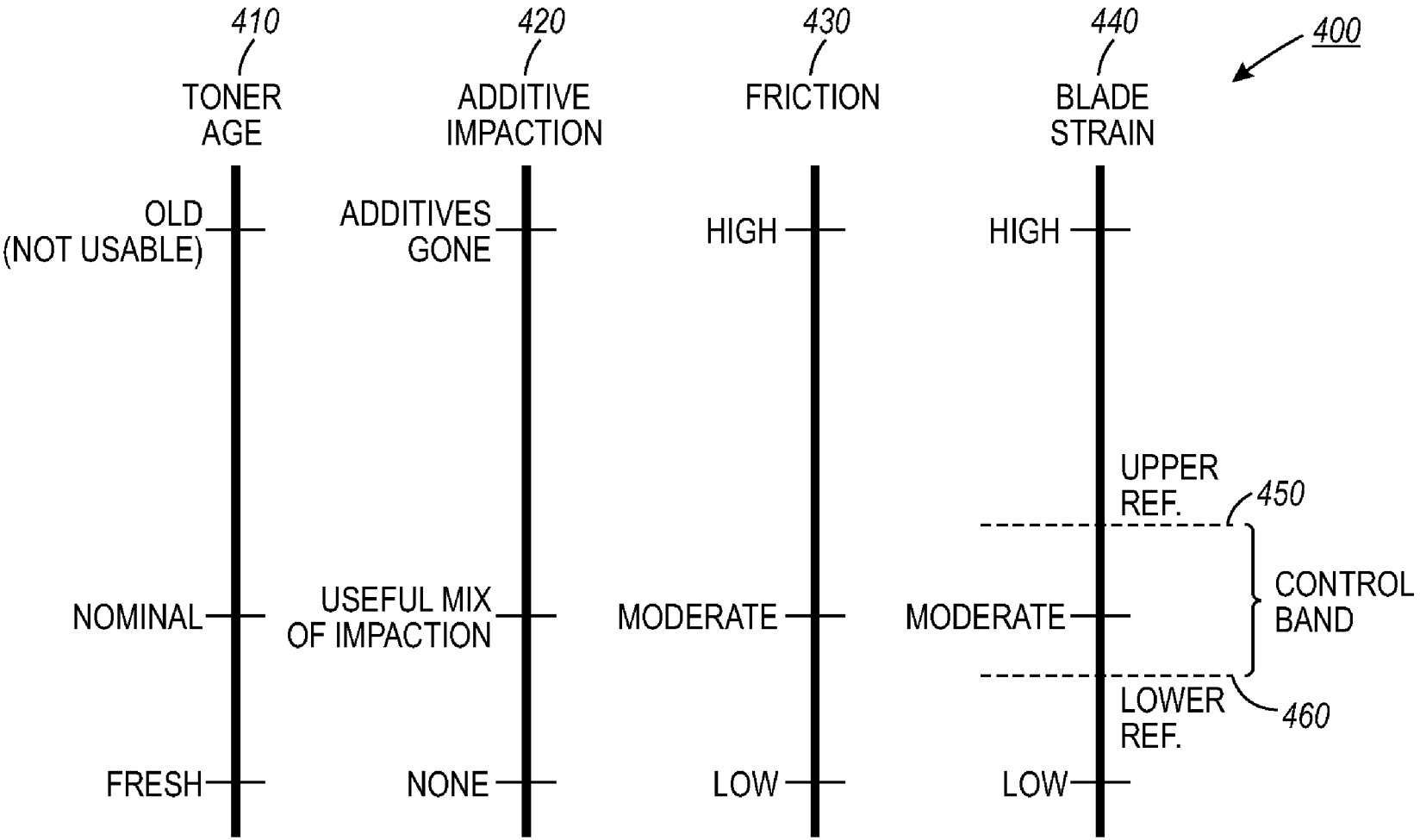
FIG. 4 is an exemplary illustration of a relationship between toner age, additive impaction, friction, and blade strain.

FIG. 4 is an exemplary illustration 400 of a relationship between toner age 410, additive impaction 420, friction 430, and blade strain 440. By comparing measured blade strain to blade strain references 440 for each of the toner colors, the measurement of toner lubrication condition can be used to infer the toner additive impaction state 420 of the toner. Toner age 410 can be controlled within a band around the desired nominal condition by adding fresh toner to the development housing to keep blade strain 440 between upper reference 450 and lower reference 460 limits. By basing the control limits on actual toner properties, the total amount of toner wasted in purge cycles can be minimized.

Embodiments may be implemented on a programmed processor. However, the embodiments may also be implemented on a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the embodiments may be used to implement the processor functions of this disclosure.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. Also, relational terms, such as "top," "bottom," "front," "back," "horizontal," "vertical," and the like may be used solely to distinguish a spatial orientation of elements relative to each other and without necessarily implying a spatial orientation relative to any other physical coordinate system. The term "coupled," unless otherwise modified, implies that elements may be connected together, but does not require a direct connection. For example, elements may be connected through one or more intervening elements. Furthermore, two elements may be coupled by using physical connections between the elements, by using electrical signals between the elements, by using radio frequency signals between the elements, by using optical signals between the elements, by providing functional interaction between the elements, or by otherwise relating two elements together. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

We claim:

1. A method in a printing apparatus including an imaging surface on which toner is placed for subsequent transfer to another surface and including an imaging surface cleaner, the method comprising:

placing the imaging surface cleaner in contact with the imaging surface;

placing a toner patch on the imaging surface;

rotating the imaging surface in a process direction;

measuring a frictional interaction between the imaging surface cleaner and the imaging surface as the toner patch passes the imaging surface cleaner;

determining whether toner should be purged based on the measured frictional interaction; and purging the toner if the toner should be purged, wherein the printing apparatus includes a photoreceptor and the imaging surface is a photoreceptor surface associated with the photoreceptor.

2. The method according to claim 1, wherein measuring comprises measuring frictional interaction between the imaging surface cleaner and the imaging surface using a sensor as the toner patch passes the imaging surface cleaner, wherein the method further comprises outputting a frictional interaction signal from the sensor indicative of the measured frictional interaction, and wherein determining comprises determining whether the toner should be purged based on the frictional interaction signal.

3. The method according to claim 2, wherein determining comprises comparing the frictional interaction signal to a threshold and determining the toner should be purged if the frictional interaction signal substantially exceeds the threshold.

4. The method according to claim 3, wherein the threshold comprises a first threshold, and wherein the method further comprises:

comparing the frictional interaction signal to a second threshold; and ceasing purging the toner if the frictional interaction signal substantially falls below the second threshold.

5. The method according to claim 1, wherein the printing apparatus includes at least one developer, wherein placing a toner patch comprises developing a toner patch on the imaging surface from the at least one developer, and wherein purging comprises dispensing toner into the at least one developer and developing toner onto the imaging surface from the at least one developer.

6. The method according to claim 5, wherein the at least one developer comprises a plurality of developers.

7. The method according to claim 1, further comprising entering a printing apparatus diagnostic mode, wherein determining whether the toner should be purged based on the measured frictional interaction is performed during the diagnostic mode.

8. The method according to claim 1, wherein the imaging surface cleaner comprises a cleaning blade, wherein measuring comprises measuring strain on the cleaning blade as the toner patch passes the cleaning blade, and wherein determining comprises determining whether the toner should be purged based on the strain on the cleaning blade.

9. A printing apparatus comprising:

an imaging surface, where the imaging surface is configured to rotate in a process direction;

an imaging surface cleaner in contact with the imaging surface;

a developer configured to develop a toner patch for placement on the imaging surface;

a sensor configured to sense a frictional interaction between the imaging surface cleaner and the imaging surface as the toner patch passes the imaging surface cleaner, a controller configured to determine whether toner should be purged based on the sensed frictional interaction and configured to control the printing apparatus to purge the toner if the toner should be purged; and a photoreceptor, where the imaging surface is a photoreceptor surface associated with the photoreceptor.

10. The printing apparatus according to claim 9, wherein the sensor is configured to output a frictional interaction signal indicative of the sensed frictional interaction, and wherein the controller is configured to determine whether the toner should be purged based on the frictional interaction signal.

11. The printing apparatus according to claim 10, wherein the controller is configured to compare the frictional interaction signal to a threshold and configured to determine the toner should be purged if the frictional interaction signal substantially exceeds the threshold.

12. The printing apparatus according to claim 11, wherein the threshold comprises a first threshold, and wherein the controller is configured to compare the frictional interaction signal to a second threshold and configured to cease purging the toner if the frictional interaction signal substantially falls below the second threshold.

13. The printing apparatus according to claim 9, wherein the controller is configured to purge the toner by controlling the printing apparatus to dispense toner into the developer and develop toner onto the imaging surface from the developer.

14. The printing apparatus according to claim 13, wherein the developer comprises a plurality of developers.

15. The printing apparatus according to claim 9, wherein the controller is configured to enter a printing apparatus diagnostic mode and configured to determine whether the toner should be purged based on the measured frictional interaction during the diagnostic mode.

16. The printing apparatus according to claim 9, wherein the imaging surface cleaner comprises a cleaning blade, wherein the sensor is configured to sense a frictional interaction between the imaging surface cleaner and the imaging surface by sensing strain on the cleaning blade as the toner patch passes the cleaning blade, and wherein the controller is configured to determine whether toner should be purged based on the sensed strain on the cleaning blade.

17. A method in a printing apparatus including at least one developer, a photoreceptor cleaning blade, a photoreceptor having a photoreceptor surface, and a sensor, the method comprising:

placing the photoreceptor cleaning blade in contact with the photoreceptor surface;

developing a toner patch on the photoreceptor surface using the at least one developer;

rotating the photoreceptor in a process direction;

measuring a frictional interaction between the photoreceptor cleaning blade and the photoreceptor surface using the sensor as the toner patch passes the photoreceptor cleaning blade;

determining whether the toner should be purged based on the measured frictional interaction; and purging the toner if the toner should be purged.

18. The method according to claim 17, wherein determining comprises comparing the measured frictional interaction to a threshold and determining the toner should be purged if the measured frictional interaction substantially exceeds the threshold.

* * * * *